US008171579B2

(12) United States Patent
Epp

(10) Patent No.: US 8,171,579 B2
(45) Date of Patent: May 8, 2012

(54) DEVICE FOR MOUNTING A GLASS OR GLASS-CERAMIC VESSEL-STYLE WASHBASIN

(75) Inventor: Bertrand Epp, Dannelbourg (FR)

(73) Assignee: Schott VTF, Troisfontaines (FR)

( * ) Notice: Subject to any disclaimer, the term of this patent is extended or adjusted under 35 U.S.C. 154(b) by 748 days.

(21) Appl. No.: 11/886,542

(22) PCT Filed: Mar. 10, 2006

(86) PCT No.: PCT/FR2006/050212

§ 371 (c)(1),
(2), (4) Date: Jan. 21, 2009

(87) PCT Pub. No.: WO2006/097654

PCT Pub. Date: Sep. 21, 2006

(65) Prior Publication Data

US 2009/0211020 A1 Aug. 27, 2009

(30) Foreign Application Priority Data

Mar. 14, 2005 (FR) ..... 05 02487

(51) Int. Cl.
*A47K 1/05* (2006.01)

(52) U.S. Cl. ..... 4/643; 4/619

(58) Field of Classification Search ..... 4/619, 631, 4/643, 652

See application file for complete search history.

(56) References Cited

U.S. PATENT DOCUMENTS

| | | | | |
|---|---|---|---|---|
| 6,349,429 | B1 * | 2/2002 | Zurba et al. | 4/661 |
| 6,799,336 | B2 * | 10/2004 | Freeman | 4/619 |
| 6,957,452 | B2 * | 10/2005 | Grant | 4/638 |
| 2003/0213063 | A1 | 11/2003 | Mayer et al. | |

FOREIGN PATENT DOCUMENTS

| | | |
|---|---|---|
| EP | 1 143 079 A | 10/2001 |
| EP | 1 340 438 A | 9/2003 |

* cited by examiner

*Primary Examiner* — Charles Phillips

(74) *Attorney, Agent, or Firm* — The Watson I.P. Group, PLC; Jovan N. Jovanovic; Vladan M. Vasiljevic

(57) ABSTRACT

The invention relates to a device for mounting a glass or glass-ceramic vessel-style washbasin (1). The inventive device is characterised in that it essentially takes the form of an adapter (3) which is disposed between the lower face of the glass or glass-ceramic vessel-style washbasin and a support (2) at the drain hole (1'), said adapter (3) being connected to the lower face of the washbasin (1) with a layer of glue (6) or an adhesive and fixed to the support (2) by means of a flow element (4). The invention is particularly suitable for household equipment, in particular vessel-style washbasins and vessel-style washbasins that are made from glass or glass-ceramic.

7 Claims, 1 Drawing Sheet

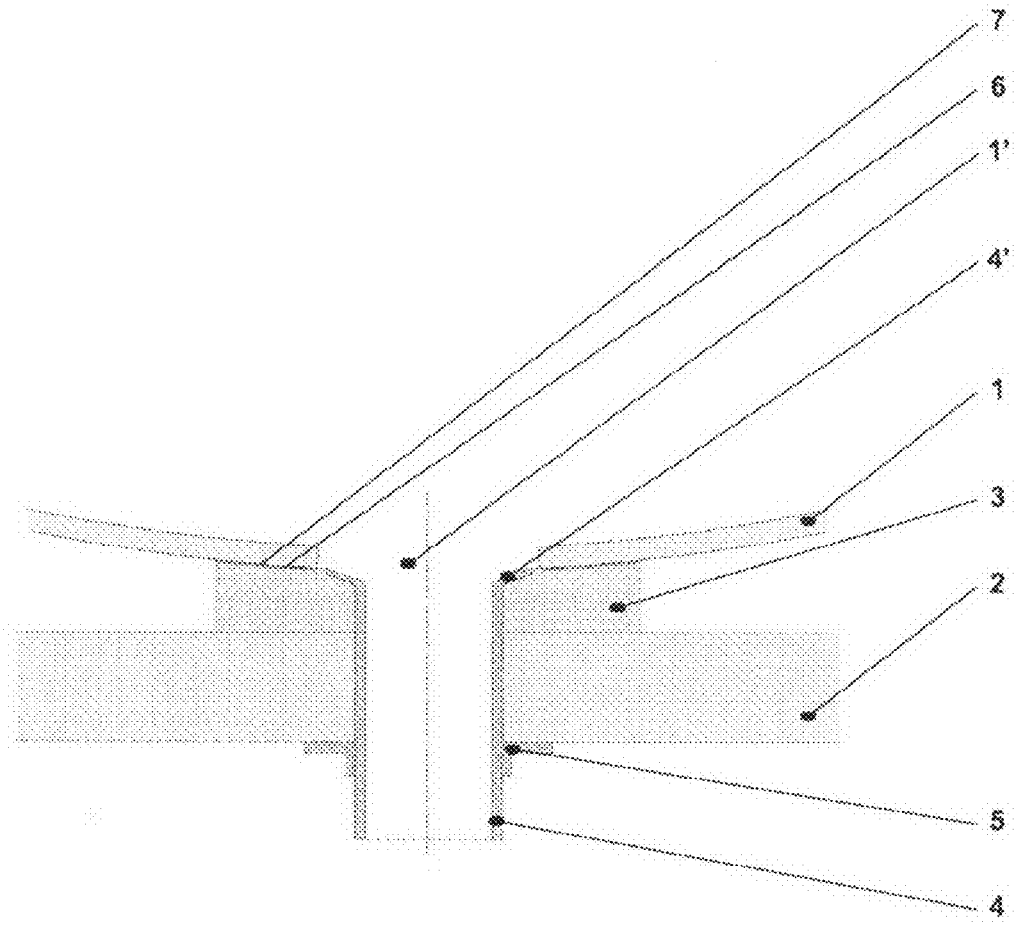
7
6
1'
4'
1
3
2
5
4

DEVICE FOR MOUNTING A GLASS OR GLASS-CERAMIC VESSEL-STYLE WASHBASIN

This invention relates to the field of domestic equipment, specifically vessel-shaped washbasins, and in particular washbasins in that shape and made of glass or glass-ceramic. It concerns a device for mounting a glass or glass-ceramic vessel-style washbasin.

Glass or glass-ceramic vessel-style washbasins intended for home use are generally made of any type of glass, and sometimes of tempered glass, and are mounted on a cabinet or other type of support.

To allow water to flow and to attach these washbasins to a cabinet, they are currently equipped with a specially reamed hole that permits mounting and accurate centering of the element that allows flow and provides the attachment when the washbasin is installed. This flow element consists of a hollow cylinder, which on its end that opens into the washbasin has a conical flange that leans on the internal edge of the reamed hole with a gasket in between. On the opposite side from the conical flange, the hollow cylinder has a threaded section for screwing on a locking and support ring. This locking ring, with the threaded hollow cylinder, forms the assembly that connects the washbasin support to the washbasin.

The current method of installing such glass or glass-ceramic vessel-shaped washbasins does satisfy all esthetic requirements, but its disadvantage is that it is somewhat fragile. Having to specifically ream the water drain hole so that the flow element can be installed reduces the thickness of the glass or glass-ceramic, thereby decreasing its mechanical characteristics. Such an assembly is described in US-2003/2130563 A1.

Furthermore, the assembly method used, i.e., the locking ring, exerts a strong tightening pressure on the reamed hole, which has the effect of subjecting the glass or glass-ceramic to constant force. It follows that, if this force becomes too great, there is a high risk of the glass or glass-ceramic breaking during installation or use.

The purpose of this invention is to eliminate these disadvantages by proposing a device for installing a glass or glass-ceramic vessel-shaped washbasin that permits quick and easy installation of such a washbasin, while avoiding the currently existing risks of damage or destruction.

Therefore, the invented device is distinguished in that it consists essentially of an adapter that is placed at the flow hole, between the lower face of the glass or glass-ceramic vessel-shaped washbasin and a support, with said adapter glued to the lower face of the washbasin and attached to the support by means of a flow element.

For a better understanding of the invention, refer to the following description, which concerns a preferred method of execution, provided as a non-limiting example, and refers to the attached schematic drawing showing a partial cutaway view of the invented device.

The FIGURE in the attached drawing shows schematically the bottom of a glass or glass-ceramic washbasin 1 mounted on a support 2 by means of a mounting device 3.

According to the invention, this mounting device 3 consists essentially of an adapter placed at the flow hole 1', between the lower face of the glass or glass-ceramic vessel-shaped washbasin 1 and the support 2, with said adapter 3 connected to the lower face of the washbasin 1 by a layer of glue 6 or an adhesive and attached to the support 2 by means of a flow element 4.

The flow element 4 is preferably in the shape of a hollow cylinder, whose end that passes through hole 1' ends in a conical flange 4' and which is threaded under said flange 4' to match a locking ring 5 that rests under the support 2, with the flange 4' preferably having a diameter smaller than that of the flow hole 1' and resting directly on the mounting device or adapter 3.

Thus, the assembly formed by gluing the mounting device or adapter 3 to the glass or glass-ceramic vessel-shaped washbasin 1 is threaded directly onto the support 2, avoiding any mechanical tightening action on the glass or glass-ceramic material of the vessel-shaped washbasin 1. The result is that specific machining of the hole 1' in the vessel-shaped washbasin 1 is no longer necessary for correct assembly of the flow element 4, since the hole 1' can consist of a simple orifice drilled conventionally.

The mounting device 3 or adapter can be made of any mineral-based, metallic, or synthetic material that is compatible with glue that can be used on the glass or glass-ceramic vessel-shaped washbasin 1. Preferably, the layer of glue 6 for attaching the glass or glass-ceramic vessel-shaped washbasin 1 is silicone-based glue. If an adhesive is used, it can be of the double-sided type.

According to one characteristic of the invention, the vessel-shaped washbasin 1 can have the advantage of being equipped with a decoration 7 of vitrified enamel screened onto a portion of its external or internal surface. Preferably, this decoration 7 extends at least around the hole 1' on a surface matching where the vessel-shaped washbasin 1 adheres to the mounting device 3 or adapter. Thus, it is possible to render the area where the vessel-shaped washbasin 1 is glued to the support 2 completely invisible.

The support 2 can consist of a cabinet, a countertop, a wall-mounted support, or any other means of holding the washbasin 1 in the proper position for use.

The invention permits the installation of glass or glass-ceramic vessel-shaped washbasins such that said vessel-shaped washbasins are held securely in position on their supports without being subjected to tightening stresses that could impair their mechanical strength.

In addition, installation according to the invention allows for an improved esthetic effect, due to the placement of the conical flange 4' on the flow element 4 inside the hole 1'.

Of course, the invention is not limited to the execution method described and shown in the attached drawing. Modifications are possible with regard to items such as the constitution of various elements or by substituting technical equivalents, without thereby exceeding the scope of the invention's protection.

The invention claimed is:

1. A device for mounting a glass or glass-ceramic vessel-shaped washbasin (1), comprising an adapter (3) placed at a flow hole (1') between a lower face of the glass or glass-ceramic vessel-shaped washbasin (1) and a support (2), with said adapter (3) connected to the lower face of the washbasin (1) by a layer of glue (6) or an adhesive and attached to the support (2) by means of a flow element (4), wherein the flow element (4) is in the shape of a hollow cylinder, having an end that passes through the flow hole (1') and terminates in a conical flange (4'), the flow element being threaded under said conical flange (4') to match a locking ring (5) that rests under the support (2), with the flange (4') having a diameter smaller than that of the flow hole (1') and resting directly on the adapter (3).

2. Device as in claim 1, distinguished in that the adapter (3) is made of a mineral-based, metallic, or synthetic material that is compatible with glue that can be used on the glass or glass-ceramic vessel-shaped washbasin (1).

3. Device as in claim 1, distinguished in that the layer of glue (6) for securing the glass or glass-ceramic vessel-shaped washbasin (1) is silicone-based glue.

4. Device as in claim 1, distinguished in that the adhesive is double-sided.

5. Device as in claim 1, distinguished in that the vessel-shaped washbasin (1) has a vitrified enamel decoration (7) screened onto its external or internal surface.

6. Device as in claim 1, further comprising a decoration (7) that extends at least around the flow hole (1') on a surface that matches the lower face of the vessel-shaped washbasin (1) where the vessel-shaped washbasin (1) adheres to the adapter (3).

7. Device as in claim 5, further comprising a decoration (7) that extends at least around the flow hole (1') on a surface that matches the lower face of the vessel-shaped washbasin (1) where the vessel-shaped washbasin (1) adheres to the adapter (3).

* * * * *